United States Patent [19]

Jones

[11] 3,978,643

[45] Sept. 7, 1976

[54] FRUIT LOADING APPARATUS

[75] Inventor: Riley L. Jones, Hendersonville, N.C.

[73] Assignee: Thomas L. Tatham Farm, Inc., Miami, Fla.

[22] Filed: July 3, 1974

[21] Appl. No.: 485,534

[52] U.S. Cl. ..... 53/160; 53/162; 53/164; 53/245

[51] Int. Cl.[2] ..... B65b 35/22; B65B 35/50

[58] Field of Search ..... 53/160, 162, 164, 244, 53/245

[56] References Cited

UNITED STATES PATENTS

| | | | |
|---|---|---|---|
| 952,352 | 3/1910 | Pieper | 53/162 X |
| 2,797,540 | 7/1957 | Carlsen et al. | 53/160 X |

*Primary Examiner*—Leon Gilden

*Attorney, Agent, or Firm*—Irvin A. Lavine

[57] ABSTRACT

Apparatus for placing fruit in layers in a box having an open side. An elevator is supported and lowered step-by-step, the elevator having a horizontal platform substantially longer than the length of the box, to permit the box to be moved to and fro on the elevator platform. A pivoted pan extending over the end portion of the platform is loaded with the proper number of pieces of fruit, and the box is manually moved on the platform so as to encompass a large part of the loaded pan, with the bottom of the box under the pan. The pan is pivoted to discharge the fruit into the box, after which the box is withdrawn from the pan by being moved on the platform. A method of loading an open-sided box.

13 Claims, 4 Drawing Figures

FIG. 2
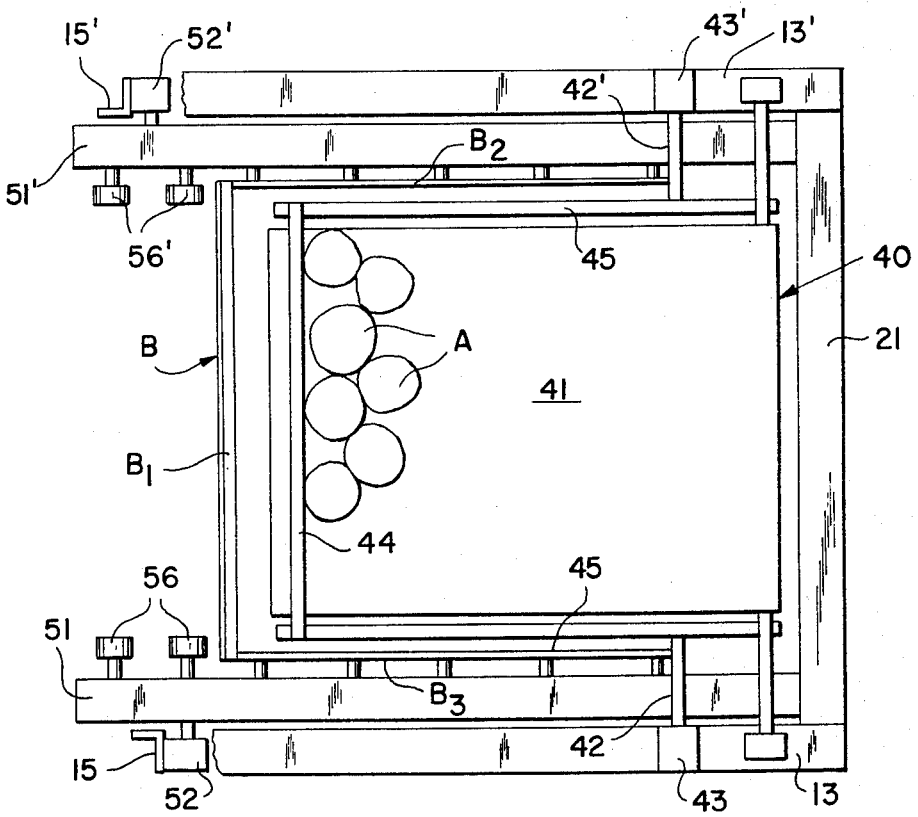
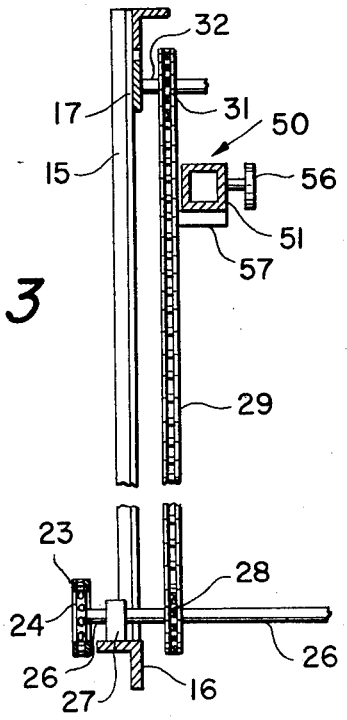
FIG. 3
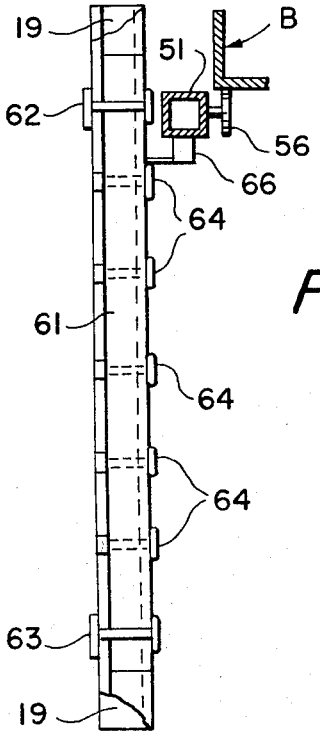
FIG. 4

FRUIT LOADING APPARATUS

BACKGROUND OF THE INVENTION

The present invention relates to fruit loading apparatus, and more particularly to apparatus for loading fruit into a shipping box or container, and to a method of loading.

In the growing and shipping of apples and other similar fruit, after the fruit is picked, transported from the orchard and treated, it is ready to be packed. Packing of apples, in particular, is by the utilization of corrugated board boxes into which the apples are placed. Conventionally, the apples are placed in the boxes in layers, each layer being supported by a compartmented tray which is sized to fit within the box, and having compartments sized in accordance with the size of the apples or other fruit being packed. A multiplicity of layers are utilized, the number of layers varying depending upon the size of the apples or other fruit being packed.

A number of proposals have been made for equipment for performing the operation of packing the apples or other fruit, or for assisting in such packing. For example, in one known apparatus, a drawer-like structure was provided having near its bottom a flat, horizontal tray support, which was movable separately from the frame-like structure of the drawer. A compartment tray was placed in this drawer-like construction, and a pivoted discharge tray above the compartmented tray was pivoted so as to discharge apples into the compartmented tray, as it was moved horizontally towards a position overlying a box or carton. When the compartmented tray, loaded with fruit and supported on the tray support had reached its intended position over the box, the tray support was rapidly retracted by a spring, thereby leaving the compartmented tray, filled with apples, unsupported: the compartmented tray thereby was permitted to fall by gravity into the box. The operation was successively repeated until the box was suitably filled.

The above referenced fruit packing apparatus was unduly complex in operation, requiring a relatively large number of parts.

In another proposal, a box was provided which was pierced at the juncture of a wall and the bottom of the box, and a plurality of parallel metal rods, specifically three rods, were inserted through the openings in the box. The rods were of inverted L-shape, and could be moved both horizontally and vertically. The horizontal portions of these rods was initially placed near the top of the box, and a compartmented tray was supported on them. Then the box with the rods therein was moved horizontally into a position under a measuring chute, and then returned: during the return movement of the carton, rods and tray, the measuring chute was tipped, to thereby load the tray. Thereafter, the support rods were stepped downwardly, a new tray was added, and the process was repeated. Here again, a complex piece of equipment was provided, and one which required handling of a box in an unusual manner, that is, by the provision of apertures therein to receive the noted rods.

Another known machine was provided for loading open-sided boxes, this machine having a loading tray carried by a pair of upstanding levers. The loading tray was caused to move, upon oscillating movement of the lever, towards the box, and was then withdrawn from the box. The loading tray was provided with a guide which depended from it, and which engaged a cam, the cam being so shaped that the tray was held generally horizontal during movement towards the open-sided box, and when it had reached its maximum travel position, with the leading edge of the tray close to the rear wall of the box, due to the action of the guide not engaging a cam, the tray was caused to pivot and vibrate, in order to release and discharge the fruit, such as apples, carried therein, the tray then being retracted by retracting movement of the oscillating lever, While this machine was generally a rapid operating machine, it was found, after a period of use, that it was inordinately expensive, and not reliable over an extended operating period. Further, it was noted for being excessively complicated, and so has not proven to be as satisfactory as desired.

The methods of loading boxes with articles placed in layers, particularly fruit, such as apples, which have heretofore been provided have either been time-consuming, required expensive, complex and difficult-to-maintain equipment, and in some instances caused damage to the articles being packed, where the articles were fruit.

SUMMARY OF THE INVENTION

The present invention provides an apparatus, and related method, the apparatus including a platform which is supported for step lowering by an elevator apparatus. The platform is slightly inclined, and is approximately twice the length of a box to be loaded. The box has an open side, and is placed on one end of the platform. Preferably, a compartmented tray is placed in the box, and the box is moved to the opposite side of the platform. Overlying the said opposite end of the platform, relatively closely thereto, is a dispenser in the form of a pivoted pan for receiving and discharging a batch of articles, such as fruit. The proper number of articles are placed in the pan, to form a layer in the box, or if a surplusage of articles are placed in the pan, the proper number of articles are separated for immediate batch discharge. The three sides of the box substantially encompass the dispensing pan when the box is at the end of the platform beneath the dispensing pan, and when so positioned, the pan is tilted so as to discharge the articles therefrom, into the box, the articles each seeking a position in the compartmented tray. The box is then returned to the initial end of the platform, another compartment tray is placed in the box, resting on the articles of the first layer, the elevator mechanism is actuated to step lower the platform, and the box is then returned to the opposite end of the platform, for receiving a second layer of articles from the pan dispenser.

In the preferred embodiment of the apparatus, and the related method, the movement of the box on the conveyor and the placement of compartmented trays in the box are accomplished manually. In addition, operator-controlled switches are used for effecting the step lowering of the elevator and the pivoting discharge movement of the dispenser pan. Relatively rapid operation is achieved, however, by viture of the utilization of an open sided box, even though some steps in the method, or parts of the operation are by hand.

An object of the present invention is to provide an apparatus and method for loading fruit into an open sided box, in layers.

Another object of the present invention is the provision of a simple and durable apparatus for loading fruit into an open sided box.

A further object of the present invention is to provide an apparatus and method for loading fruit in an open sided box which is rapid, even though partial manual operation is required.

A still further object of the present invention is the provision of an apparatus as above referred to which is reliable, and inexpensive.

BRIEF DESCRIPTION OF THE DRAWING

FIG. 2 is a plan view of the apparatus of FIG. 1, with parts broken away.

FIG. 3 is a cross sectional view taken on the line 3—3 of FIG. 1.

FIG. 4 is a cross sectional view taken on the line 4—4 of FIG. 1.

DESCRIPTION OF THE PREFERRED EMBODIMENT

Figure 1:
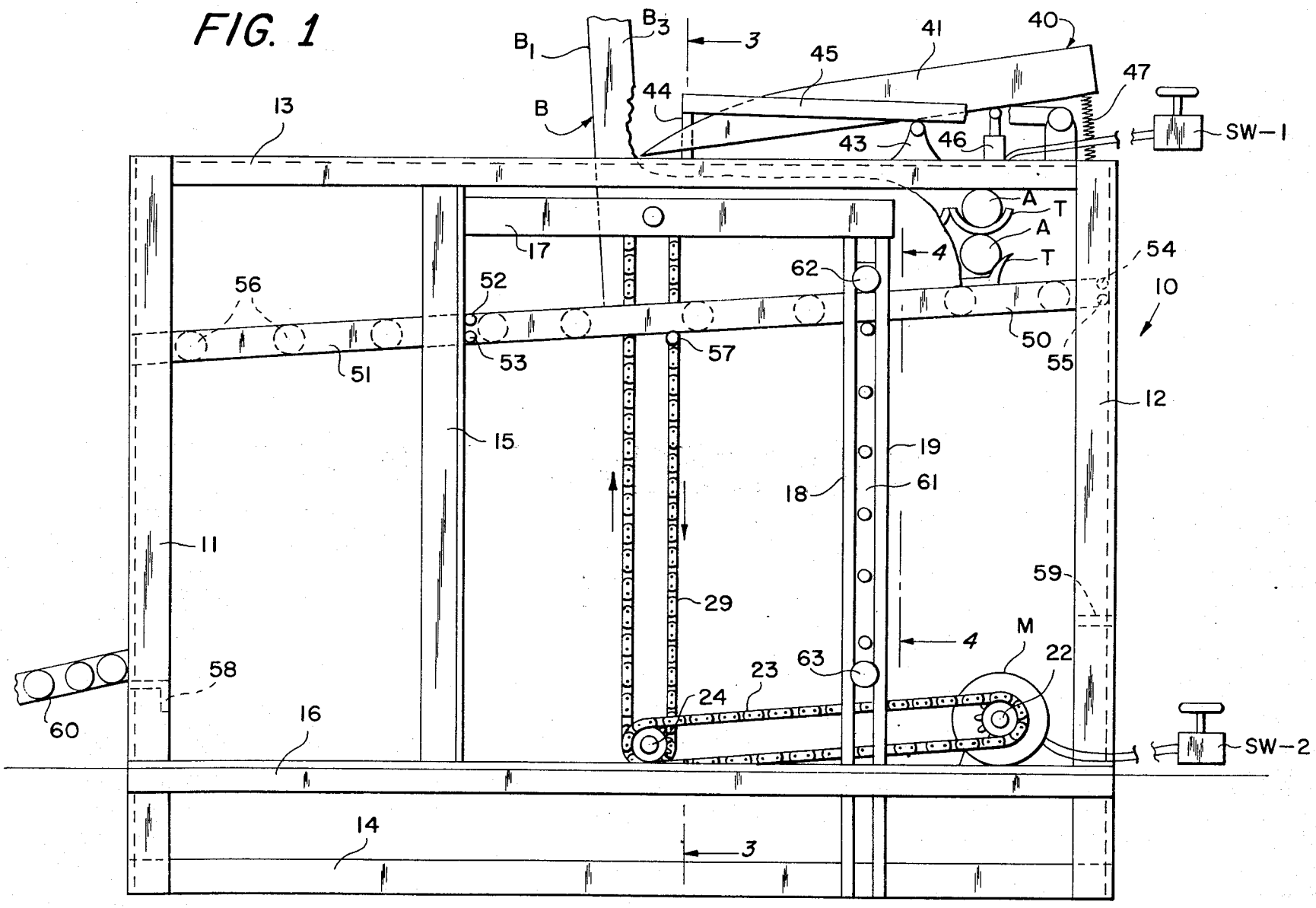
FIG. 1 is a side elevation, with parts broken away, of an apparatus for packing fruit in an open sided box in accordance with the present invention.

Referring now to the drawings, wherein like or corresponding reference numerals are used for like or corresponding parts throughout the several views, there is shown in FIG. 1 an apparatus an open sided box B, which is broken away. As may be seen from FIG. 2, the box B has a rear wall B-1 and side walls B-2 and B-3, but has no wall opposite the rear wall B-1. The box B has a bottom, and after being loaded with plural layers of fruit, such as apples, a telescoping top is placed over the box B.

The apparatus 10 comprises a skeletal frame of generally box-like configuraion, including vertical and horizontal frame members which are principally angle-irons. Thus, as shown in FIG. 1, there are end posts 11 and 12 which are angle-irons, a top frame member 13 and a bottom frame member 14. In addition, there is a vertical intermediate frame member 15 which extends downwardly from the top frame member 13 to a horizontal intermediate frame member 16. Frame member 16 extends between the end posts 11 and 12, being connected to them.

Also forming part of the frame, as seen in FIG. 1, are a horizontal plate 17 extending from and connected to the vertical intermediate frame member 15, and a pair of spaced strips 18 and 19 which extend vertically between the horizontal plate 17 and the bottom frame member 14.

As will be understood, the frame of the apparatus 10 comprises a second side, substantially identical to the side shown in FIG. 1, and suitable cross frame members are provided. Thus, as shown in FIG. 2, there is a second top frame member 13′ parallel to the top frame member 13, a transverse top member 21, and there may also be seen in FIG. 1 vertical intermediate frame members 15 and 15′.

Referring again to FIG. 1, there may be seen a motor M mounted on the horizontal intermediate frame member 16, and having a sprocket 22 thereon, with a drive chain 23 engaging the sprocket 22. Drive chain 23 drives a sprocket 24 (see FIG. 3) which is supported by an axle 26 carried by a trunnion 27 mounted on the horizontal frame member 16. The axle 26 also carries a sprocket 28, in engagement with which is an elevator chain 29.

Elevator chain 29 is carried by a sprocket 31 which is supported by an axle 32 which is in turn carried by the horizontal plate 17. As is seen in FIG. 3, the axle 26 extends transversely across the apparatus 10, where there is provided on the opposite side a second elevator drive chain mounted on two vertically spaced sprockets, the construction of which is substantially identical to that illustrated in FIGS. 1 and 3.

As is shown in FIGS. 1 and 2, intermediate the top frame members 13 and 13′ is a fruit dispenser 40, comprising a conventional pan 41 which is open at its rear or right hand end as viewed in these Figures, for receiving plural pieces of fruit, such as apples, which form a batch, from a supply conveyor (not shown). The pan 41 is supported on the top frame members 13, 13′ by by horizontally extending axles 42 and 42′, carried on bearing blocks 43 and 43′. A gate 44 extends across the left, discharge end of pan 41, being carried by arms 45, 45′, arm 45 being shown broken away in FIG. 1. A solenoid 46 is mounted on the frame, and is controlled by a switch SW-1, controlled by an operator, so that a batch of apples or other fruit in the pan 41 may be discharged by closing the switch SW-1, to actuate the solenoid and thereby pivot the pan in a counterclockwise manner, viewed from FIG. 1, and there may be provided a suitable spring, such as spring 47, to return the pan 41 to its normal position, as shown in FIG. 1. The pan 41 may be seen in FIG. 2 to have a width which is less than the width of the frame of the apparatus 10. The box B may be seen in FIG. 2, in position so that it substantially encompasses the pan 41, with the sides B-2 and B-3 extending beside a major portion of the pan 41, with the rear wall B-1 extending gnerally parallel to the discharge end of pan 41.

An elevator is provided for supporting and step lowering the box B, the elevator including, in addition to the vertical intermediate frame members 15 and 15′, the end post 12 and its corresponding end post on the opposite side of the apparatus 10. These four vertically extending frame members constitute the track for the elevator, the elevator also comprising the platform 50. As is seen in FIG. 1, the platform 50 is somewhat inclined to the horizontal, and comprises a side member 51, there being a corresponding side member 51′ as shown in FIG. 2. Extending outwardly from the side members 51 and 51′ are pairs of rollers 52, 53 which engage a flange of the vertical intermediate frame member 15. In FIG. 2, there may be seen a corresponding roller 52′ engaging a flange of vertical intermediate frame member 15′. Also extending outwardly from the frame members 51 and 51′ are additional guide rollers 54 and 55 which engage a flange of the end post 12, the engagement on the opposite side of the frame of the apparatus 10 being substantially identical. Thus, in the embodiment illustrated, there are four rollers on each of the side members 51, 51′ of the platform 50, which engages flanges of vertically extending frame members, and which thereby confine the platform 50 to vertical movement, and which cause it to maintain the inclined position shown in FIG. 1.

Referring to FIG. 3, there may be seen the side member 51 of platform 50, with a roller 56 carried thereby, inwardly thereof. These rollers may be seen to constitute a series of rollers, as shown in FIG. 1, and the side frame member 51′ is provided with a similar series of rollers 56′. It is on these rollers that the box B is supported for movement along the platform, from the piston shown in FIG. 1 and in FIG. 2, in which the box substantially encompasses the dispenser means 40, to an alternate position, wherein the rear side B-1 of the box B is adjacent the plane of the end post 11 and its corresponding end post on the opposite side of the frame.

As will be seen in FIG. 3, extending inwardly from the elevator chain 29 is a bar 57. Bar 57 is shown broken away, and may have a sufficient length to extend across the apparatus, and be connected to the elevator chain on the side of the apparatus underlying the top frame member 13'. The bar 57 serves to support the platform 50, enabling it to be lowered as the sprockets 28 and 31 rotate and the chain 29 moves downwardly, and also when bar 57 is on the run of chain 29 closest to the vertical intermediate frame member 15, the bar 57 will cause the platform 51 to rise. The platform 50 can rise to a height as determined by the passage of rod 57 over the top of the sprocket 31. It can descent to a level determined by the stops 58 and 59 which extend transversely across the apparatus 10, in which lower position of the platform 50, the platform 50 is at a level to discharge the loaded box B onto an off-take rollered chute 60 of conventional construction.

Referring now to FIG. 4, there is shown an apparatus for step lowering of the platform. Thus, there is shown in FIG. 4 the strip 19, which is in the form of a small angle-iron, there being shown only the portions near the upper and lower ends thereof, and there also being shown the strip 18, also in the form of an angle-iron. A stop member support 61 is provided, in the form of an elongated block, adjustably secured in position by upper and lower fasteners 62 and 63 having heads which engage flanges of the strips 18 and 19. On the inside of the stop member support 61 are a plurality of stop members 64, in the form of bolts which extend through the stop member support member 61. The heads of the bolts forming stop member 64 may be seen to extend inwardly, or to the right, and are in the path of a micro-switch 66, secured to the side member 51 of platform 50. There may also be seen in FIG. 4 one of the rollers 56, supporting the box B. Referring to FIG. 1, it may be seen that the motor M is connected to a switch SW-2, for control by the operator. A conventional circuit is provided for causing the motor M to rotate when the switch SW-2 is depressed, thereby causing the platform 50 to be moved through the movement of the drive chain 23, elevator chain 29 and bar 57. The platform 50 will descend until the micro-switch 66 engages the next below stop member 64, specifically the head of the bolt, where the circuit to the motor M will be broken, and movement of the platform 50 will thereby halt. As will be understood, another engagement of switch SW-2 will repeat the process, stepping the platform 50 and the box B downwardly, until the bottom position is reached as determined by the stops 58 and 59, after which the loaded box B will be discharged onto the chute 60.

It is often desirable to use an apparatus for the packaging of apples of different sizes, in which case there will be varying numbers of layers of apples to be packed, as is conventional. Thus, with larger sized apples, fewer layers are required to fill the standard size box. To accommodate for variation in the number of layers, the stop member support 61 may be set up for the desired number of layers, and may be quickly exchanged for an alternate stop member 61, having a different number and spacing of the stop members 64 thereon. As will be understood, this requires no change in the electrical connections, and may be accomplished easily.

In operation, a box B having an open side is positioned on the platform 50 near the end portion thereof which is adjacent to the end post 11. It is thus laterally spaced from the dispenser 40, and in particular from the discharge end of the pan 41. The elevator's platform 50 will be in its uppermost position. A compartmented tray of known construction, generally designated T in FIG. 1 is placed in the bottom of the box B, the tray having the proper number of compartments for the size of fruit, such as apples, to be packed, and having a length and width enabling it to fit conveniently in the three sides of the box B. The platform 50 has a length which is slightly greater than the length of the top and bottom frame members 13 and 14, due to its slight inclination, and has a length which is substantially greater than the length of the box B, the term "length" in relation to the box B being the length of the side walls B-2 and B-3 as viewed in FIG. 2. The box B is then moved to the other end or portion of the platform 50, which is that portion which underlies the dispenser 40. This movement is done manually by the operator. The operator has previously either placed a batch of fruit, such as apples, in the pan 41, or has supervised the placement of a batch of fruit therein, as by a delivery conveyor, (not shown). The operator then actuates the switch SW-1, which energizes solenoid 46 and causes the pan 41 to pivot and thereby discharge the batch of fruit therein, the bottom of pan 41 being in this position spaced from the gate 44 to permit such discharge. The box B, when in the position shown in FIG. 1, substantially encompasses the pan 41, and is closely adjacent to the discharge edge of pan 41 in its discharge position. Consequently, the fruit has only a very limited distance through which to fall, so that bruising of the fruit is substantially avoided. In addition, due to the encompassing of the pan 41 by the box B, there is substantially no chance that an apple or other fruit will escape, but instead the batch, being the appropriate number of apples or other fruit to form a layer, will be discharged from the pan 41 so that each piece of the batch will occupy one of the compartments in the compartmented tray T. The box B may be permitted to move back to the original position from the position shown in FIG. 1, or to the left as shown in FIG. 1, either while the apples are being discharged from pan 41, or substantially immediately thereafter, any apples which have not sought and filled a compartment being quickly positioned manually by the operator. Thee operator then engages the switch SW-2, which may be a foot switch, to energize the motor M and enable the platform 50 and the box B to move downwardly one step. Thereafter, a second compartmented tray T is placed on the first layer of apples A, and the box B returned to its position encompassing and underlying the pan 41, where the discharging and elevator lowering steps are successively repeated through operation of the switches SW-1 and SW-2.

When the box has been filled, or substantially filled, the elevator 50 will be near its lower position, and further lowering movement thereof will cause it to rest on the stops 58, 59, and the filled box B will then be discharged from the apparatus 10 as above set forth.

There has been disclosed herein an apparatus and method for loading fruit into an open sided box, in layers, the apparatus being constructed of readily available and economical materials, being of simple construction, and durable for repeated operations over a long period of time. The herein disclosed apparatus is rapid in operation, as is the method herein, and such rapidity is achieved even though a number of the steps involved are manual. The herein disclosed apparatus does not require frequent adjustment or repairs, and thereby may operate without significant down time, especially during the relatively short packing seasons which obtain for the various fruits capable of being packed by the apparatus disclosed.

It will be obvious to those skilled in the art that various changes may be made without departing from the spirit of the invention and therefore the invention is not limited to what is shown in the drawings and described in the specification but only as indicated in the appended claims.

I claim:

1. Apparatus for loading fruit into an open sided box by successively discharging into the box a series of batches or pieces of fruit each sufficient to form a complete layer in the box and by continuously moving the box without stopping between a first position underlying a discharging means and a second position spaced from the first position, comprising:

a. means for receiving and discharging plural pieces of fruit; said means having a capacity at least sufficient to receive a batch of fruit sufficient to form a complete layer in the box;

b. platform means for supporting a box for uninterrupted movement between a first position substantially underlying said first mentioned means in which position discharge of a batch of fruit thereinto is initiated, and a second position laterally spaced from said first position, said platform means having a first portion underlying said receiving and discharging means and a second portion laterally thereof for supporting a box in said second position;

c. elevator means for supporting and step-lowering said platform, and d. means for causing said first mentioned means to discharge a said batch of fruit therefrom into a box on said first portion of said elevator means whereby to discharge a batch of fruit sufficient to form a complete layer into the box, e. said apparatus being free of means for stopping the continuous movement of said box between said first and second positions, whereby a box may be continuously moved without stopping between said positions.

2. The apparatus of claim 1, said first mentioned means comprising a pan, and means supporting said pan for movement between receiving and discharge positions.

3. The apparatus of claim 1, said first mentioned means comprising a pan, and means supporting said pan for oscillating movement about a horizontal axis.

4. The apparatus of claim 2, said last mentioned means comprising a solenoid connected to said pan, and operator controlled switch means for actuating said solenoid.

5. The apparatus of claim 1, said elevator means comprising vertically extending frame means, for guiding said platform for movement along said frame means.

6. The apparatus of claim 5, wherein said frame means comprises a pair of spaced side frame members, said platform being between said side frame members and said portion of said platform extending beyond said side frame members.

7. The apparatus of claim 6, said platform comprising means facilitating movement of a box thereon.

8. The apparatus of claim 7, said platform comprising a series of transverse rollers.

9. The apparatus of claim 5, said elevator means further comprising a pair of spaced side frame members, an electric motor, a pair of vertically spaced sprockets journalled to each of said side frame members, the upper sprockets and the lower sprockets being in axial alignment, chains trained over each pair of sprockets, and means for connecting said chains and said platform for conjoint movement.

10. Apparatus for loading fruit into an open sided box comprising:

a. elevator means including platform means;

i. said platform means comprising means for supporting a load in two positions thereon and including first and second adjacent adjacent load support portions, ii. said platform means comprising means enabling a load to move between said positions free of interrruption, iii. means for causing said platform means to descend in step-by-step manner; and b. fruit receiving and discharging means located generally above one said load support portion of said platform means for discharging successive batches of fruit downwardly therefrom;

i. said fruit receiving and discharging means comprising operator control means for causing discharge of fruit therefrom, ii. said fruit receiving and discharging means having a capacity at least sufficient to receive a batch of fruit sufficient to form a complete layer of fruit in the box;

c. said apparatus being free of means for stopping the continuous movement of said box between said first and second positions, whereby a box may be continuously moved without stopping between said positions.

11. The apparatus of claim 10, wherein said fruit receiving and discharging means comprises a pivoted tray.

12. The apparatus of claim 10, said means for causing said platform means to descend comprising operator controlled means.

13. The apparatus of claim 10, wherein said elevator means comprises frame means for guiding said platform means.

* * * * *